US012502700B2

(12) United States Patent
Kirchner

(10) Patent No.: US 12,502,700 B2
(45) Date of Patent: Dec. 23, 2025

(54) ROLLING MILL STAND WITH VARIABLE LATERAL GUIDE DEVICE

(71) Applicant: SMS group GmbH, Düsseldorf (DE)

(72) Inventor: Walter Kirchner, Viersen (DE)

(73) Assignee: SMS group GmbH, Düsseldorf (DE)

( * ) Notice: Subject to any disclaimer, the term of this patent is extended or adjusted under 35 U.S.C. 154(b) by 207 days.

(21) Appl. No.: 18/272,624

(22) PCT Filed: Dec. 28, 2021

(86) PCT No.: PCT/EP2021/087719
§ 371 (c)(1),
(2) Date: Jul. 17, 2023

(87) PCT Pub. No.: WO2022/152558
PCT Pub. Date: Jul. 21, 2022

(65) Prior Publication Data

US 2024/0408658 A1 Dec. 12, 2024

(30) Foreign Application Priority Data

Jan. 18, 2021 (DE) ..... 10 2021 200 391.5

(51) Int. Cl.
*B21B 13/02* (2006.01)

(52) U.S. Cl.
CPC ..... *B21B 13/02* (2013.01)

(58) Field of Classification Search
CPC ..... B21B 13/02; B21B 39/04; B21B 39/16; B21B 39/165
See application file for complete search history.

(56) References Cited

U.S. PATENT DOCUMENTS

| | | | | |
|---|---|---|---|---|
| 4,669,296 | A * | 6/1987 | Bald | B21B 13/142 72/247 |
| 5,479,805 | A | 1/1996 | Koenen et al. | |
| 5,636,542 | A | 6/1997 | Yamakawa et al. | |
| 2002/0000113 | A1 | 1/2002 | Hoffgen et al. | |

FOREIGN PATENT DOCUMENTS

| | | | |
|---|---|---|---|
| DE | 3326263 | A1 | 1/1984 |
| DE | 4308721 | C1 | 3/1994 |
| DE | 20020702 | U1 | 8/2001 |
| DE | 10020702 | A1 | 10/2001 |
| DE | 112016000717 | B4 | 1/2020 |
| EP | 2050518 | A1 | 4/2009 |
| JP | S59169607 | A | 9/1984 |
| JP | S6127108 | A | 2/1986 |
| JP | H05177220 | A | 7/1993 |
| JP | H05200412 | A | 8/1993 |
| RU | 2678625 | C1 | 1/2019 |
| WO | 2016128923 | A1 | 8/2016 |

* cited by examiner

*Primary Examiner* — Teresa M Ekiert
(74) *Attorney, Agent, or Firm* — Smartpat PLC

(57) ABSTRACT

A rolling mill stand (1) for rolling an elongated workpiece, preferably in an cross rolling mill, wherein the rolling mill stand (1) has: two working rolls (20) forming a rolling gap(S), which are designed to roll the workpiece conveyed along a rolling direction (R); at least one guide device (30) with at least one guide (40), which is designed to laterally support the workpiece in the rolling gap(S) by the guide (40) being in contact with the workpiece; wherein the guide device (30) has an angle adjuster (33), which is designed to pivot the guide (40) about one or more, preferably three, spatial axes (x, y, z).

20 Claims, 6 Drawing Sheets

ROLLING MILL STAND WITH VARIABLE LATERAL GUIDE DEVICE

CROSS-REFERENCE TO RELATED APPLICATION

This application is a national stage application, filed under 35 U.S.C. § 371, of International Patent Application PCT/EP2021/087719, filed on Dec. 28, 2021, which claims the benefit of German Patent Application DE 10 2021 200 391.5, filed on Jan. 18, 2021.

TECHNICAL FIELD

The disclosure relates to a rolling mill stand for rolling an elongated workpiece, preferably in a cross rolling mill, with a lateral guide device.

BACKGROUND

For the production of metallic long products, such as bars, seamless tubes and the like, cross-rolling and elongating mills are used, in which, in general, two to three working rolls perform the desired forming of the workpiece. For this purpose, the roll axes of the working rolls are crossed. The working rolls can be barrel-shaped or cone-shaped and also inclined relative to the rolling direction. A cross-shaped offset of the working rolls against one another causes a longitudinal feed of the workpiece and a rotation about its own axis. For lateral support of the workpiece, fixed or rotatable disc-shaped guides are used in cross rolling mills equipped with two working rolls; these are known accordingly as "guide shoes" or "guide or edge rulers," as the case may be, and "Diescher discs."

A cross rolling mill with Diescher discs that can be moved on sliding rails running transverse to the rolling direction between a maintenance position and an operating position is shown in DE 100 20 702 A2. WO 2016/128923 A1 describes a cross-rolling mill stand for seamless tubes with exchangeable lateral guides. The cross-rolling mill stand comprises two revolving towers, each of which can be rotatable about its vertical axis for positioning the lateral guides and is equipped with couplings for fastening fixed guide shoes or, alternatively, rotatable guide discs. A holding device for fixed or alternatively rotating guides is also shown in DE 33 26 263 A1.

In order to achieve the best possible rolling result for different workpieces and in different process situations, a high variability of the lateral guides is desirable, both in terms of the basic structure—fixed or rotatable guide—and in terms of the setting options relative to the workpiece. However, high variability of the guide device generally has a detrimental effect on machine durability and rigidity.

SUMMARY

One object of the invention is to provide an improved rolling mill stand for rolling an elongated workpiece, preferably in a cross rolling mill, in particular to increase variability while maintaining the high machine durability and rigidity and/or the quality of the rolled products.

The object is achieved by a rolling mill stand with the features of claim 1. Advantageous further embodiments follow from the subclaims, the following description of the invention and the description of preferred exemplary embodiments.

The rolling mill stand set forth herein is for rolling an elongated workpiece of metal, particularly steel or a non-ferrous metal. The rolling mill stand is preferably used in a cross rolling mill, for example for the elongation of round bars or for the production of seamless tubes. The term "cross rolling mill" is used here to include cross rolling and elongating mills of all types, such as barrel-shaped cross rolling mills, conical cross rolling mills and Assel rolling mills, along with Mannesmann cross rolling mills.

The rolling mill stand comprises two working rolls forming a rolling gap, which are designed to roll the workpiece conveyed along a rolling direction, i.e. to reshape it by pressure, in particular to reduce its cross-section. The working rolls can be designed both as conical rolls and as barrel rolls with crossed roll axles. The rolling mill stand further comprises a guide device having at least one guide, which is designed to support the workpiece in the rolling gap laterally against the axis formed by the working rolls by the guide being in contact with the workpiece.

Therein, "lateral support" means that the guide(s) act on the workpiece on one or more sides or regions, as the case may be, in which the workpiece is not in contact with the working rolls. Thereby, the guide(s) not only ensure defined transport of the workpiece along the rolling direction, but they can also have a shaping effect on the workpiece. Such a guide can be realized, for example, by a Diescher disc or a guide shoe.

In accordance with the invention, the guide device has an angle adjuster that is designed to pivot the guide about one or more, preferably all three, spatial axes.

Such angle adjuster allows the guide to be positioned at an angle relative to the rolled material even during the rolling process. Degrees of freedom of this type, in particular with the option of adjusting the angles even during rolling, enable rolling of high quality in a wide range of workpiece and process situations, making the guide device particularly variable. When using Diescher discs, for example, the ability to set the angular position(s) allows improved workpiece guidance during cross rolling. Furthermore, osculation can be improved by a narrower gap between the working roll and the guide, making larger diameter/wall thickness ratios feasible. Through an angular positioning of the guide, a reduction of the required size of the guide device and a reduction in costs may be obtained. A compact design contributes to an improved removal of contamination along with higher machine rigidity.

In addition, the option of actively adjusting the guide tools during rolling can sustainably improve workpiece quality. In this manner, the rolling process can be stabilized at an early stage during the rolling process by moving the guide tools in the direction of the so-called "inlet side," thus improving product quality, for example in the case of tubes, with regard to the eccentricity of the rolled product or diameter deviations. Likewise, at the end of the rolling process, the rolling process can be kept stable for longer by moving the tools in the direction of the so-called "exit side," thus reducing or avoiding defects or geometric deviations there.

By superimposing pivoting movements about two or three spatial axes through the angle adjuster, it is also possible to achieve translation in space.

Preferably, the angle adjuster is designed to pivot the guide about a spatial axis parallel to the rolling direction. By varying the positioning about a spatial axis running parallel to the rolling direction, a reduction in the size of the guide can be achieved, in particular in the case of a Diescher disc. This is because such an inclined position allows the guide length to be increased along the rolling direction. This is accompanied by a further reduction in the required size of the guide device and an increase in machine rigidity.

Preferably, the guide device comprises a guide frame and a pivoting bracket or a pivoting mounting frame, as the case may be, or a tool table (hereinafter collectively referred to as "pivot bracket"), via which the guide frame is mounted on a machine base of the rolling mill stand so as to be pivoting about a first spatial axis and/or a second spatial axis and/or a third spatial axis. The pivot bracket implements the pivot axes about which the guide frame, including the guide, can be pivoted. With such a modular bracket solution, the desired variability can not only be realized in a compact manner in terms of mechanical engineering, but the guide device can also be designed with differently aligned and a different number of pivot axes as required.

The designations "first," "second," "third" do not imply any sequence, order or prioritization herein. They are used only for the linguistic differentiation of various spatial axes, angle adjuster and angle clamping units, which are described further below. The spatial axes are perpendicular to one another, wherein the third spatial axis is by definition the spatial axis that runs parallel to the rolling direction. The first spatial axis preferably coincides with the direction of gravity.

Preferably, the pivot bracket comprises a bracket mount that is firmly mounted on the machine base along with a bracket body that is mounted on the bracket mount via a pivot pin and can be pivoted about the first spatial axis perpendicular to the rolling direction. In this manner, the pivoting capability about the first spatial axis can be realized in a structurally compact manner and with high machine rigidity.

Preferably, the angle adjuster comprises a first angle adjuster unit with an actuator for adjusting the pivoted position about the first spatial axis. The actuator is preferably an electric motor, for example a servo motor or a stepper motor, in order to realize a stepless or quasi-stepless angle adjustment. A force can be transmitted via a suitable gearing, for example a worm drive with a worm shaft and a worm wheel or a hydraulic cylinder. Particularly preferably, a first angle clamping unit is also provided, which is designed to fix the guide frame in the desired pivoted position, thus achieving further stabilization and improvement of the machine rigidity while maintaining a high degree of variability.

Preferably, the pivot bracket comprises a rotating joint that connects the bracket body to the guide frame via a rotating pin so that it can pivot about the second spatial axis, which is perpendicular to the first spatial axis and perpendicular to the rolling direction. The rotating joint can be used on a stand-alone basis or in combination with the pivot pin set forth above.

Preferably, the angle adjuster comprises a second angle adjuster unit with an actuator for adjusting the pivoted position about the second spatial axis. Here as well, the actuator is preferably an electric motor, for example a servomotor or a stepper motor or a hydraulic cylinder, in order to realize a stepless or quasi-stepless angle adjustment. A force can be transmitted via a suitable gearing, for example a worm drive with a worm shaft and a worm wheel. Particularly preferably, a second angle clamping unit is also provided, which is designed to fix the guide frame in the desired pivoted position, thus achieving further stabilization and improvement of the machine rigidity while maintaining a high degree of variability. The second angle adjuster unit along with the second angle clamping unit may be provided on a stand-alone basis or in combination with the first angle adjuster unit or first angle clamping unit, as the case may be.

Preferably, the rotating joint is mounted on the bracket body so as to be rotatable about the third spatial axis, i.e. about an axis parallel to the rolling direction. In other words, the rotating joint allows the guide frame to be rotated perpendicular to the axis of the rotating pin, if present, by providing a rotational adjustment between the rotating joint and the bracket body. The rotational assembly of the rotating joint on the bracket body can be implemented on a stand-alone basis or in combination with the pivot pin, for example.

By means of a pivot bracket constructed in this manner, a pivot unit can be implemented in a structurally compact and stable manner that enables the guide to be rotated about one, two or all three spatial axes.

Preferably, the angle adjuster comprises a third angle adjuster unit with an actuator for adjusting the pivoted position about the third spatial axis. The actuator is preferably an electric motor, for example a servo motor or a stepper motor or a hydraulic cylinder, in order to realize a stepless or quasi-stepless angle adjustment. A force can be transmitted via a suitable gearing, for example a worm drive with a worm shaft and a worm wheel, a toothed rack and a toothed wheel, or a hydraulic cylinder and a lever. Particularly preferably, a third angle clamping unit is also provided, which is designed to fix the guide frame in the desired pivoted position, thus achieving further stabilization and improvement of the machine rigidity while maintaining a high degree of variability. The third angle adjuster unit along with the third angle clamping unit may be provided on a stand-alone basis or in combination with the first angle adjuster unit or first angle clamping unit, as the case may be, and/or second angle adjuster unit or second angle clamping unit, as the case may be.

In addition to the angle adjuster for the pivoting positioning of the guide, means for a translational adjustment may be installed. For this purpose, the guide device preferably comprises an eccentric receptacle and at least one eccentric bushing, which is received in the eccentric receptacle so as to be rotatable about a longitudinal axis. The eccentric bushing can be actuated by an eccentric adjuster with an actuator for adjusting the angle of rotation of the eccentric bushing. The eccentric adjuster can have a worm drive with a worm shaft and a worm wheel and an electric motor drive, for example a stepper motor or a servo motor or a toothed rack and a toothed wheel or a hydraulic cylinder and a lever. By turning the eccentric bushing in the eccentric receptacle, it is possible to adjust the guide in the plane perpendicular to the eccentric bushing axis, i.e. in the plane of the second and third spatial axes.

In order to be able to reach any position within a square adjustment range, an outer eccentric bushing and an inner eccentric bushing are preferably provided, which are plugged axially into one another and are each rotatably received in the eccentric receptacle. The adjustment range is defined via the two eccentric radii of the eccentric bushings. The respective adjustment, i.e. The rotation of the two eccentric bushings about the respective longitudinal axes, is preferably carried out via an outer eccentric adjuster and an inner eccentric adjuster. The eccentric adjusters may each have a worm drive with a worm shaft and a worm wheel and an electric motor drive, for example a stepper motor or a servomotor or a toothed rack and a toothed wheel or a hydraulic cylinder or an electromechanical drive and a lever, as the case may be.

The eccentric bushings are cylindrical objects that run in a quasi-concentric manner. In other words, the eccentric bushings are objects with an outer cylinder and a plane-parallel cylindrical inner bore, wherein the centers of the outer cylinder and the inner bore are offset from one another by a certain amount. In this manner, the guide can be adjusted in the plane perpendicular to the axial or longitudinal, as the case may be, direction of the eccentric bushings in a structurally compact manner with high machine rigidity. Adjustment via eccentric bushings also enables the easy sealing of the guide elements.

The superimposition of the angle adjustment by the outer and inner eccentric adjusters enables a translational adjustment of the guide(s) along with an adjustment of the guide(s) in a plane parallel to the workpiece plane.

Preferably, the guide device has a shaft on which the guide is mounted and which can be set in rotation by a drive, for example an electric drive or hydraulic drive, directly or via a mechanical gearing. For this purpose, the shaft can have a flange in the lower region for connection to a rotary drive. At the opposite end, the guide, for example a Diescher disc, is mounted via a corresponding bearing. The shaft preferably runs approximately, i.e. regardless of any angle positioning, in the direction of gravity.

Preferably, the shaft extends in the axial direction through an eccentric bushing, in the case of two eccentric bushings through the inner eccentric bushing, by which the associated variability can be achieved in a structurally particularly compact manner.

Preferably, the guide device has a displacement sleeve through which the shaft extends axially, wherein the displacement sleeve is designed to displace the shaft axially. Preferably, an axial adjuster is provided with an actuator, preferably an electric motor, which is designed to adjust the shaft together with the displacement sleeve in the axial direction. The axial displaceability of the shaft provides a further degree of freedom for positioning the guide in a structurally compact manner. The rotation of the shaft is realized, for example, via radial and/or axial bearings relative to the displacement sleeve. The axial adjustment function takes place between the inner eccentric bushing and the displacement sleeve. Any compensating movements may be compensated for by an intermediate cardan shaft or spindle, provided that the rotary drive for the shaft is mounted in a manner fixed on an external component.

Preferably, the guide is detachably and exchangeably mounted on the shaft, by which different guide tools may be applied for different purposes and requirements. The corresponding mounting can, for example, be designed as a cantilevered mounting.

The set of mountable guides preferably comprises a Diescher disc and/or a guide ruler holder for receiving one or more guide shoes.

The rotary drive of the shaft can be used for the continuous drive of a Diescher disc or for rotational adjustment with a discretely settable angular position for a fixed guide, for example the guide ruler holder mentioned.

The guide ruler holder is preferably formed to be elongated and enables the assembly of guide shoe or edge ruler, as the case may be, at both ends. In this manner, disassembly/assembly, maintenance, etc. of a guide shoe can be performed during the operation of the system.

Preferably, the guide is adjustable during the rolling process for the reasons mentioned above. For this purpose, a controller can be provided, which is designed to calculate corresponding parameters of the adjustment or setting, as the case may be, of the guide during the rolling process.

The setting parameters for the guide(s) can be optimized by the controller, wherein measured values from the process such as forces, power consumption of motors and/or geometric measured values from the rolled material may be evaluated for optimization and used to correct the setting data. Thereby, the current rolled material can be measured directly, and/or evaluations of measurement data from previous workpieces can be used to calculate the corrections. Special computational algorithms, for example on the basis of Fourier analysis, artificial intelligence or neural networks, may be used to evaluate the measured values.

Further advantages and features of the present invention are apparent from the following description of preferred exemplary embodiments. The features described therein can be implemented on a stand-alone basis or in combination with one or more of the features set forth above, provided the features do not contradict one another. The following description of the preferred exemplary embodiments is made with reference to the accompanying drawing.

BRIEF DESCRIPTION OF THE DRAWINGS

Preferred further exemplary embodiments of the invention are explained in more detail by the following description of the figure. The following are shown.

DETAILED DESCRIPTION

Preferred exemplary embodiments are described below with reference to the figures. In doing so, identical, similar or similarly acting elements are provided with identical reference signs in the various figures, and a repeated description of such elements is partially omitted, in order to avoid redundancy.

Figure 1:
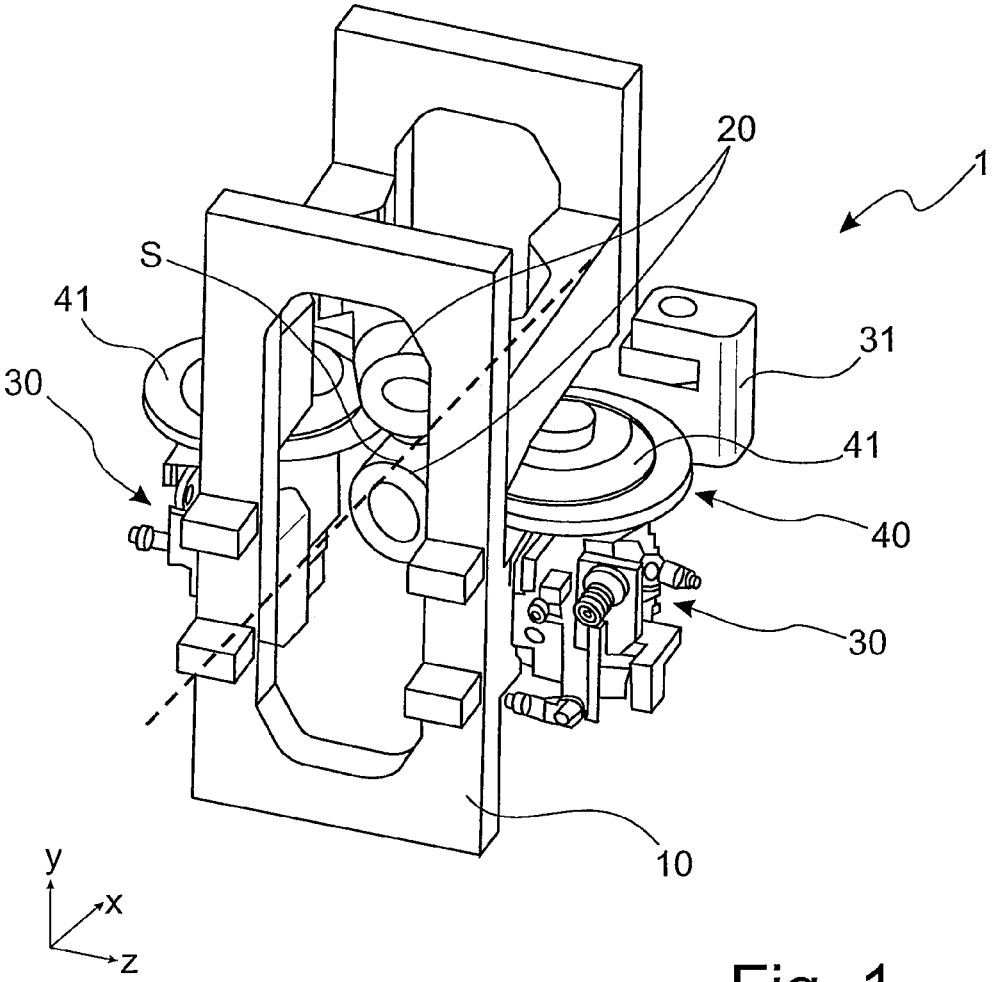
FIG. 1 is a perspective, schematic view of a rolling mill stand for an cross rolling mill with two cross rolls and guide devices for the lateral stabilization of the workpiece to be rolled.

FIG. 1 schematically shows a rolling mill stand 1 for a cross rolling mill for rolling long products made of a metal. Long products made of steel or a non-ferrous metal are particularly suitable for this purpose. The cross rolling mill can, for example, be designed as a stretch rolling mill for elongating round bars or a piercing mill for producing seamless tubes.

The rolling mill stand 1 comprises a machine base 10 and two working rolls 20 rotatably mounted therein, which are opposite one another in a y-direction and form a rolling gap S. The y-direction preferably coincides with the direction of gravity. In the rolling gap S, the forming of an elongated workpiece takes place, which is not shown in FIGS. 1 to 5. During rolling, the workpiece is transported along a rolling direction R, which is parallel to the spatial axis referred to herein as the x-direction. The remaining spatial axis is drawn in the figures as the z-direction.

The working rolls 20 are set in rotation for regular operation by a drive, not shown in detail in the figures. The working rolls 20 are formed to be cone-shaped and inclined, i.e. the axes of the working rolls 20 are crossed and run at an angle to the x-direction and the y-direction, by which the workpiece is propelled in the x-direction during rolling and at the same time rotated about the x-axis.

The rolling mill stand 10 further comprises two guide devices 30, which are designed to stabilize the workpiece in the z-direction. In the exemplary embodiment of FIG. 1, the guide devices 30 each have, by way of example, a rotatably mounted Diescher disc 41, whose axes of rotation extend substantially in the y-direction and engage in the rolling gap at the same height in the y-direction, by which the workpiece is laterally stabilized.

The guide device 30 may carry, as an alternative to the Diescher discs 41, one or more guide shoes, described in more detail below, an edge ruler or the like, collectively subsumed herein under the designation "guide" 40.

The two guide devices 30 may be of substantially identical or mirror-inverted construction. One of the guide devices 30 is shown enlarged in FIG. 2.

The guide device 30 permits an adjustment of the guide 40 along at least one, preferably all, spatial axes x, y, z along with the inclination of the guide 40 about one, preferably all, spatial axes x, y, z. The adjustment can be stepless and is preferably realized via individual drives.

Initially, with reference to FIG. 2, the rotational adjustment options, i.e. the change of the inclination of the guide 40, will be explained.

For this purpose, the guide device 30 has a pivot bracket 31, which is mounted on the machine base 10 via a bracket mount 31*a*. The pivot bracket 31 comprises a bracket body 31*b* that can be pivoted relative to the bracket mount 31*a* about a first spatial axis, herein by way of example an axis parallel to the y-direction. A pivot pin 31*c* is provided for this purpose, which supports the two components of the pivot bracket 31, i.e. the bracket body 31*b* and the bracket mount 31*a*, so that they can pivot relative to one another.

The pivoting capability of the guide 40 about a second spatial axis, herein by way of example an axis parallel to the z-direction, is realized by means of a rotating joint 31*d*, which connects in a pivoting manner the pivot bracket 31 and a guide frame 32 of the guide device 30. The rotating joint 31*d* comprises a rotating pin 31*e*, which supports in a pivoting manner the two components, i.e., the pivot bracket 31 and the guide frame 32, relative to one another.

The pivoting capability about the remaining third spatial axis, herein by way of example the x-axis, can be implemented by mounting the rotating joint 31*d* on the bracket body 31*b* so as to be rotatable about an axis parallel to the x-axis. In other words, through the rotating joint 31*d*, the guide frame 32 can be rotated perpendicular to the axis of the rotating pin 31*e*, by a rotational adjustment taking place between the rotating joint 31*d* and the bracket body 31*b*.

By means of a pivot bracket 31 constructed in this manner, a pivot unit can be implemented in a structurally compact and stable manner, which enables the rotation of the guide 40 about one, two or all three spatial axes.

The rotary adjustment is performed with the aid of an angle adjuster 33, implemented by drives correspondingly assigned to the pivot axes. An angular clamping function 34 can be provided, if necessary, in order to enable a zero-clearance locking of the guide 40 in the desired angular position.

For example, the angle adjuster 33 comprises a first angle adjuster unit 33*a*, which is designed for a pivoting movement about the y-axis, i.e., about the pivot pin 31*c*. Preferably, an associated first angular clamping unit 34*a* is provided, which enables the zero-clearance clamping in the desired plane of rotation. Spherical or ball-shaped domes can be used for this purpose. The first angle adjuster unit 33*a* can comprise a servo motor or a stepper motor, in order to realize a stepless or quasi-stepless angle adjustment. A force can be transmitted via a suitable gearing, for example a worm drive with a worm shaft and a worm wheel.

In addition to the option of changing the positioning of the guide 40 about the y-axis, it is possible via the pivot bracket 31 to pivot the guide frame 32 out of the machine base 10 after it has been unclamped by the first angle clamping unit 34*a*, for example for the purpose of a tool change. The swinging out from the machine base 10 can be effected by a hydraulic cylinder or an electromechanical solution, not shown in the figures.

The guide device 30 can further have a second angle adjuster unit, which is designed for a pivoting movement about the z-axis, i.e. about the rotating pin 31*e*. Preferably, an associated second angle clamping unit is provided, which enables zero-clearance clamping in the desired plane of rotation. Spherical or ball-shaped domes can be used for this purpose. The second angle adjuster unit can comprise a servo motor or a stepper motor, in order to realize a stepless or quasi-stepless angle adjustment. Force can be transmitted via a suitable gearing, for example a worm drive with a worm shaft and a worm wheel. The second angle adjuster unit along with the second angle clamping unit are not visible in the perspective of FIG. 2.

The rotational adjustment about the x-axis is effected by means of a third angle adjuster unit 33*c*. Preferably, an associated third angular clamping unit 34*c* is provided, which enables the zero-clearance clamping in the desired plane of rotation. Spherical or ball-shaped domes can be used for this purpose. The third angle adjuster unit 33*c* can comprise a servo motor or a stepper motor, in order to realize a stepless or quasi-stepless angle adjustment. A force can be transmitted via a suitable gearing, for example a worm drive with a worm shaft and a worm wheel.

Through the angle adjuster 33 set forth above, the guide 40 can be positioned at an angle relative to the rolled material. Such degrees of freedom, in particular the positioning about the x-axis by means of the third angle adjuster unit 33*c*, enable a reduction in the size of the guide device 30, in particular of any mounted Diescher disc 41. This is because the guide length along the rolling direction R can be increased by an inclined position of the Diescher disc 41. This is accompanied by a reduction in the required size of the guide device 30 along with a reduction in costs.

Figure 3:
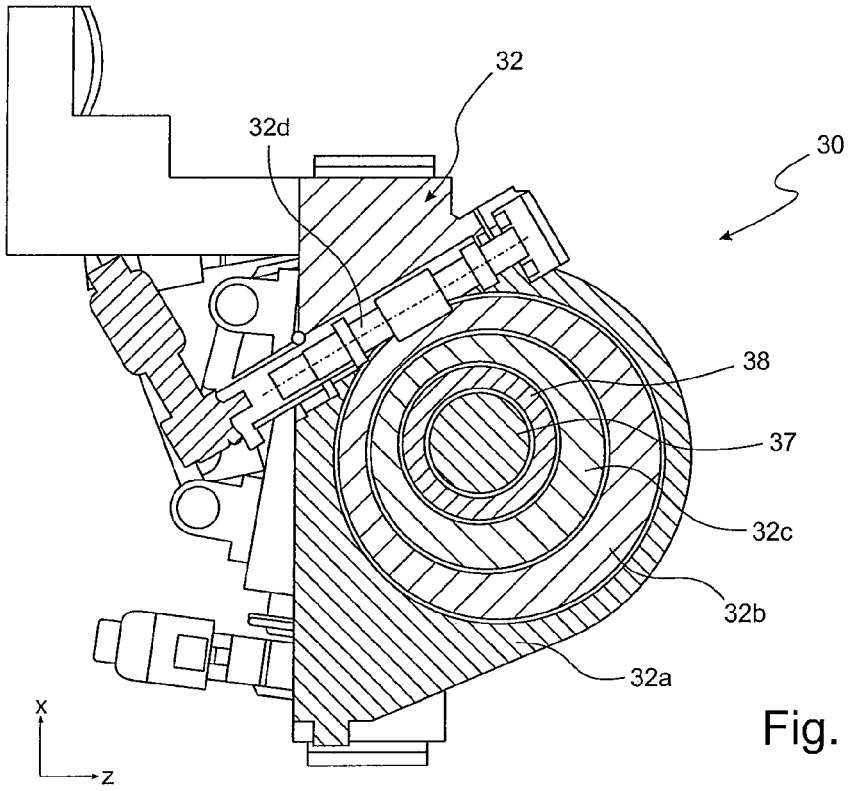
FIG. 3 is a cross-section through the guide device perpendicular to the axial direction.

In accordance with the present exemplary embodiment, the translational adjustment options are realized via a double eccentric adjuster, which is described in the following with reference to FIGS. 3 and 4.

For this purpose, the guide frame 32 is formed as or comprises an eccentric receptacle 32*a*. In the eccentric receptacle 32*a*, there are two eccentric bushings axially plugged into one another, an outer eccentric bushing 32*b* and an inner eccentric bushing 32*c*, which are rotatable relative to one another.

The adjustment, i.e. rotation of the two eccentric bushings 32*b*, 32*c* about the respective longitudinal axes, which are essentially substantial to the y-direction, is performed accordingly via an outer eccentric adjuster 32*d* and an inner eccentric adjuster 32*e*. The eccentric adjusters 32*d*, 32*e* may each have a worm drive with a worm shaft and a worm wheel and an electric motor drive, such as a stepper motor or a servo motor. By rotating the respective eccentric bushing 32*b*, 32*c* in the eccentric receptacle 32*a*, it is possible to adjust the guide 40 in the plane perpendicular to the eccentric bushing longitudinal axes, i.e. in the x-z plane. The adjustment range is defined via the eccentric radii of the eccentric bushings 32*b*, 32*c*.

A shaft 37 extends through the inner eccentric bushing and can be set in rotation by an electric drive or a hydraulic drive, either directly or indirectly via a mechanical gearing. For this purpose, the shaft 37 comprises a flange 37*a* in the lower region for connection to a rotary drive. At the opposite end, the guide 40, such as the Diescher disc 41 shown in FIG. 4, can be mounted via a mounting 39, which in FIG. 4 is designed by way of example as a cantilevered mounting 39*a*, and can thus be set in rotation via the shaft 37.

The shaft 37 extends axially through a displacement sleeve 38, via which the axial adjustment of the shaft 37 and thus of the guide 40 is made possible. For this purpose, an axial adjuster 38*a* is provided, which can adjust the shaft 37 together with the displacement sleeve 38 in the axial direction. The rotation of the shaft 37 is realized via radial and/or axial bearings relative to the displacement sleeve 38. The axial adjustment is effected between the inner eccentric bushing 32*c* and the displacement sleeve 38. Any compensating movements may be compensated for by a intermediate mounted cardan shaft or spindle, provided that the rotary drive for the shaft 37 is mounted in a fixed manner on an external component.

Figure 2:
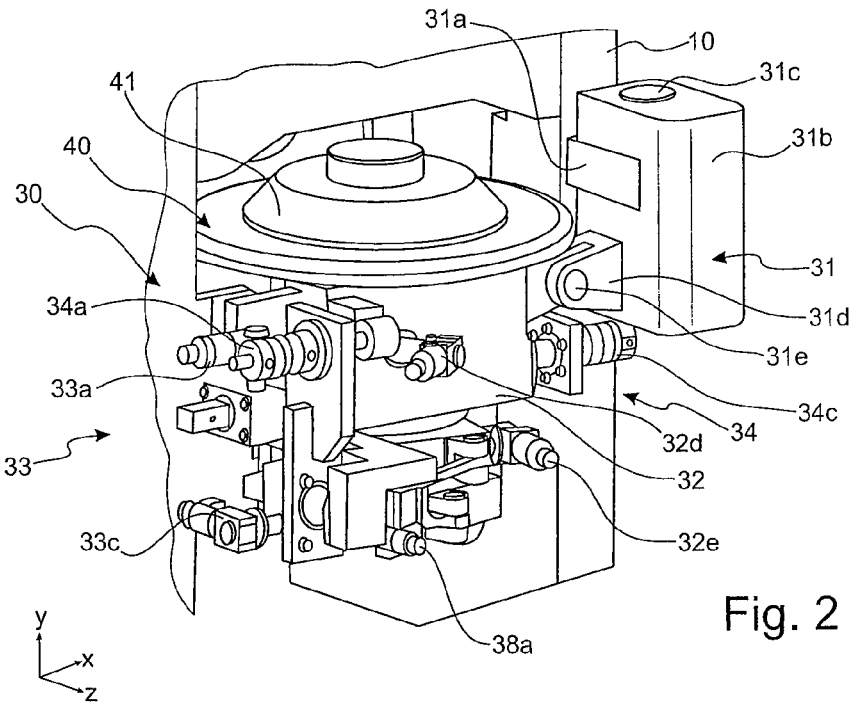
FIG. 2 is a perspective, schematic view of a guide device with a mounted Diescher disc.
Figure 4:
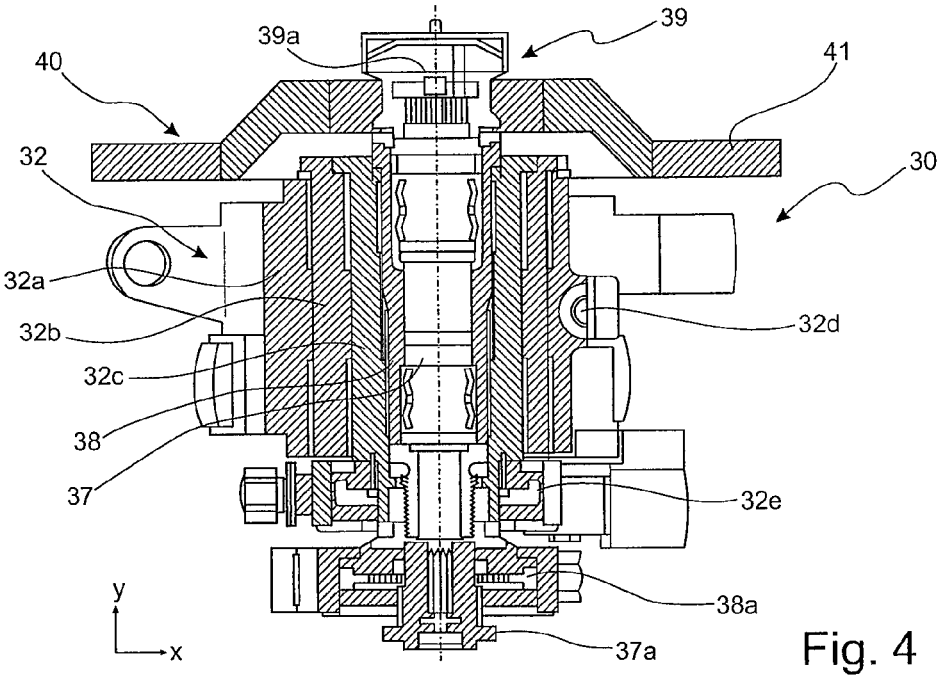
FIG. 4 is a longitudinal section through the guide device with a mounted Diescher disc.
Figure 5:
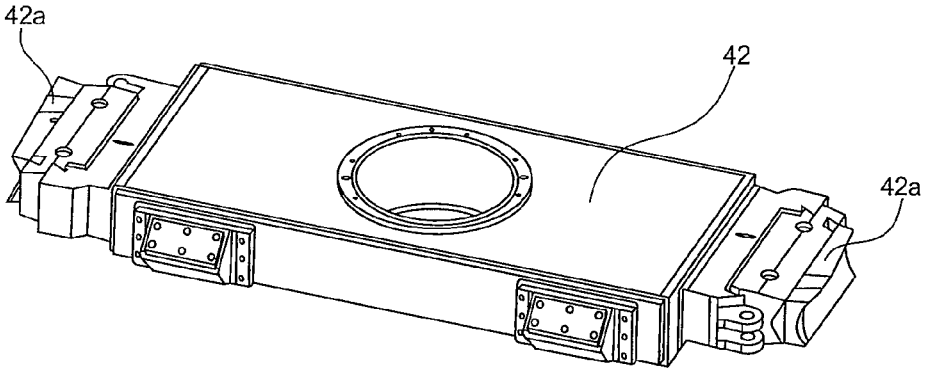
FIG. 5 is a perspective view of a guide ruler holder with guide shoes mounted on both sides.

The rotary drive of the shaft 37 can be applied to continuously drive a Diescher disc 41, as shown in FIGS. 1, 2 and 4, or to rotationally adjust it with a discretely settable angular position for a further, usually fixed or stationary, as the case may be, guide 40, for example a guide ruler holder 42, shown in FIG. 5. In the exemplary embodiment of FIG. 5, the guide ruler holder 42 is formed to be elongated and enables the assembly of a guide shoe 42*a* or edge ruler, as the case may be, at each end. In this manner, disassembly/assembly, maintenance, etc. of a guide shoe 42*a* can be performed during regular operation of the system. However, the guide ruler holder 42 can also be formed to assemble exactly one guide shoe 42*a* or more than two guide shoes 42*a*. For this purpose, the guide ruler holder 42, which is seated on the shaft 37 and has two or more guide shoes 42*a*, can be adjusted in the angle of rotation and blocked at any angle of rotation.

Figure 6:
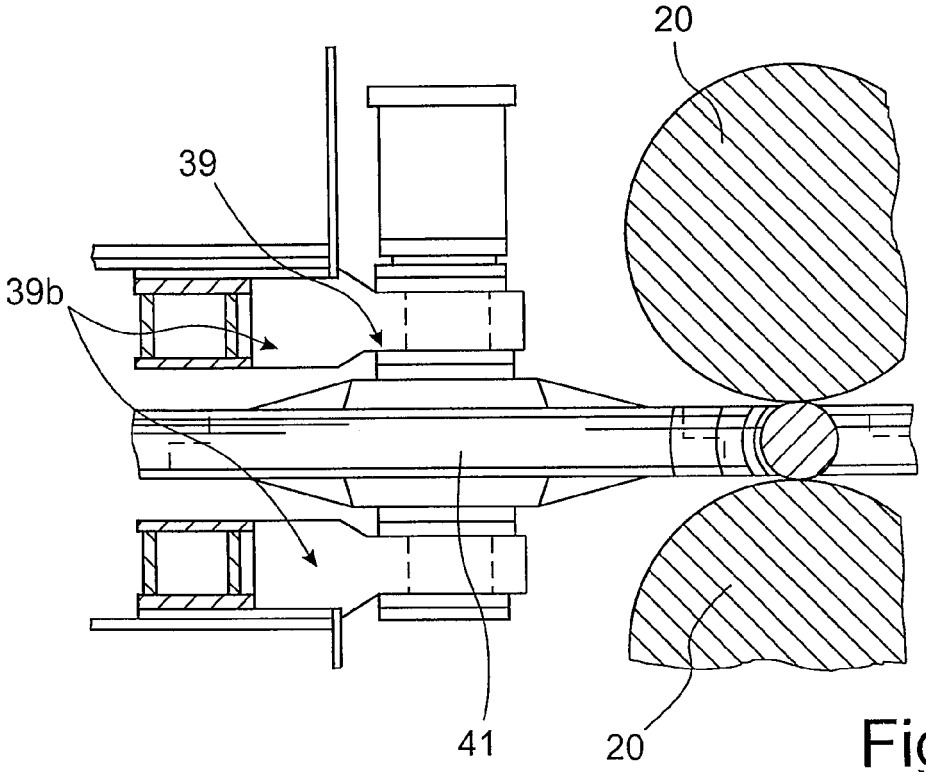
FIG. 6 is schematically, a double-sided mounting for the guide as an alternative to the cantilevered mounting in accordance with FIG. 4.

The fastening of the Diescher disc 41 or the guide ruler holder 42 in the form of a cantilevered mounting 39*a* shown in FIG. 4 can alternatively be realized by a mounting 39*b* on both sides of the guide 40, as shown in FIG. 6.

In addition to a vertical change in a swung-out position or rolling position, the Diescher disc 41 or the guide ruler holder 42 can also be removed in the rolling position by a slight vertical lift and a lateral extension similar to a pallet truck.

The high variability of the guide device 30 set forth herein permits rolling of high grades with thin walls in a variety of workpiece and process situations. When using Diescher discs 41, the ability to set the angular position(s) allows improved workpiece guidance during cross rolling. Furthermore, osculation can be improved by a narrower gap between the working roll 20 and the guide 40, by which larger diameter/wall thickness ratios can be realized. The guide device 30 comes with a reduced maintenance requirement due to better sealable round guides 40. Furthermore, the particularly compact design contributes to an improved removal of contamination along with higher machine rigidity.

At any point in time during the production process, a decision can be made between the advantageous guide principles-Diescher discs 41, guide shoes 42, etc.—with little effort. The variable positionings enable the best possible guidance of the rolled product. The adjustment of the positionings via eccentric bushings 32*b*, 32*c* enables the easy sealing of all guide elements. The rigidity of the machine base 10 along with the product wall thickness tolerance are improved. The positioning accuracy increases and depends to a lesser extent on the forming forces. Any adverse effects due to contamination along with maintenance effort are significantly minimized.

The rolling process is subjected to open-loop or closed-loop control by a controller not shown in the figures. The controller can be centralized or decentralized, software-based, part of Internet-based and/or cloud-based applications, or implemented in other manners, as well as accessing databases where appropriate. The communication of the controller with the corresponding components can be digital or analog, wireless or wired.

Preferably, the guide 40 is adjustable during the rolling process. For this purpose, the controller is designed to calculate corresponding parameters of the adjustment or setting, as the case may be, of the guide 40 during the rolling process.

The setting parameters for the guide(s) 40 can be optimized by the controller, wherein measured values from the process, such as forces, power consumption of motors and/or geometric measured values from the rolled material may be evaluated for optimization and used to correct the setting data. Thereby, the current rolled material can be measured directly, and/or evaluations of measurement data from previous workpieces can be used to calculate the corrections. Special computational algorithms, for example on the basis of Fourier analysis, artificial intelligence or neural networks, may be used to evaluate the measured values.

To the extent applicable, any of the individual features shown in the exemplary embodiments may be combined and/or interchanged without departing from the scope of the invention.

LIST OF REFERENCE SIGNS

1 Rolling mill stand
10 Machine base
20 Working roll
30 Guide device
31 Pivot bracket
31*a* Bracket mount
31*b* Bracket body
31*c* Pivot pin
31*d* Rotating joint
31*e* Rotating pin
32 Guide frame
32*a* Eccentric receptacle
32*b* Outer eccentric bushing
32*c* Inner eccentric bushing
32*d* Outer eccentric adjuster
32*e* Inner eccentric adjuster
33 Angle adjuster
33*a* First angle adjuster unit
33*c* Third angle adjuster unit
34 Angle clamping
34*a* First angle clamping unit
34*c* Third angle clamping unit
37 Shaft

37*a* Flange
38 Displacement sleeve
38*a* Axial adjuster
39 Mounting
39*a* Cantilevered mounting
40 Guide
41 Diescher disc
42 Guide ruler holder
42*a* Guide shoe
S Rolling gap
R Rolling direction
x, y, z Spatial axes

The invention claimed is:

1. A rolling mill stand (1) for rolling an elongated workpiece, comprising:

two working rolls (20) forming a rolling gap(S), which are configured to roll the workpiece conveyed along a rolling direction (R); and a guide device (30) having a guide (40) configured to laterally support the workpiece in the rolling gap(S) by the guide (40) being in contact with the workpiece and an angle adjuster (33) which is configured to pivot the guide (40) about one or more spatial axes (x, y, z), wherein the guide device (30) comprises an eccentric receptacle (32*a*) and an eccentric bushing (32*b*), which is received in the eccentric receptacle (32*a*) so as to be rotatable about a longitudinal axis.

2. The rolling mill stand (1) according to claim 1, wherein the angle adjuster (33) is configured to pivot the guide (40) about a spatial axis (x) parallel to the rolling direction (R).

3. The rolling mill stand (1) according to claim 1, wherein the guide device (30) comprises a guide frame (32) and a pivot bracket (31), by which the guide frame (32) is mounted on a machine base (10) of the rolling mill stand (1) so as to be pivoting about a first spatial axis (y) and/or a second spatial axis (z) and/or a third spatial axis (x).

4. The rolling mill stand (1) according to claim 3, wherein the pivot bracket (31) comprises a bracket mount (31*a*) that is firmly mounted on the machine base (10) and a bracket body (31*b*) that is mounted on the bracket mount (31*a*) by a pivot pin (31*c*) and can be pivoted about the first spatial axis (y) perpendicular to the rolling direction (R).

5. The rolling mill stand (1) according to claim 3, wherein the angle adjuster (33) comprises a first angle adjuster unit (33*a*) with an actuator for adjusting a desired pivoted position about the first spatial axis (y), and a first angular clamping element (34*a*), which is configured to fix the guide frame (32) in the desired pivoted position.

6. The rolling mill stand (1) according to claim 3, wherein the angle adjuster (33) comprises a second angle adjuster unit with an actuator for adjusting a desired pivoted position about the second spatial axis (z), and a second angular clamping element, which is configured to fix the guide frame (32) in the desired pivoted position.

7. The rolling mill stand (1) according to claim 3, wherein the angle adjuster (33) comprises a third angle adjuster unit (33*c*) with an actuator for adjusting a desired pivoted position about the third spatial axis (x), and a third angular clamping element (34*c*), which is configured to fix the guide frame (32) in the desired pivoted position.

8. The rolling mill stand (1) according to claim 1, further comprising an eccentric adjuster (32*d*) with an actuator for adjusting an angle of rotation of the eccentric bushing (32*b*), wherein the eccentric adjuster (32*d*) comprises a worm drive driven by the actuator and having a worm shaft and a worm wheel or a toothed gearing having a toothed rack and a toothed wheel.

9. The rolling mill stand (1) according to claim 1, wherein the guide device (30) comprises an outer eccentric bushing (32*b*) and an inner eccentric bushing (32*c*) that are plugged axially into one another and are each received in the eccentric receptacle (32*a*) so as to be rotatable about a longitudinal axis.

10. The rolling mill stand (1) according to claim 9, further comprising an outer eccentric adjuster (32*d*) with an actuator for adjusting an angle of rotation of the outer eccentric bushing (32*b*) and/or an inner eccentric adjuster (32*e*) with an actuator for adjusting an angle of rotation of the inner eccentric bushing (32*b*), wherein the outer eccentric adjuster (32*d*) and/or the inner eccentric adjuster (32*e*) comprises a worm gear driven by the corresponding actuator and having a worm shaft and a worm wheel or a toothed gearing having a toothed rack and a toothed wheel.

11. The rolling mill stand (1) according to claim 9, wherein the guide device (30) comprises a shaft (37) on which the guide (40) is mounted and which can be set in rotation by a drive directly or via a mechanical gearing.

12. The rolling mill stand (1) according to claim 11, wherein the shaft (37) extends in an axial direction through the inner eccentric bushing (32*c*).

13. The rolling mill stand (1) according to claim 11, wherein the guide device (30) comprises a displacement sleeve (38) through which the shaft (37) extends axially, wherein the displacement sleeve (38) is configured to displace the shaft (37) axially, and wherein an axial adjuster (38*a*) with an actuator is provided, which is configured to adjust the shaft (37) together with the displacement sleeve (38) in the axial direction.

14. The rolling mill stand (1) according to claim 11, wherein the guide (40) is detachably and situationally exchangeably mountable on the shaft (37), wherein the guide (40) comprises a Diescher disc (41) and/or a guide ruler holder (42) for receiving one or more guide shoes (42*a*).

15. The rolling mill stand (1) according to claim 1, wherein the guide device (30) is height-adjustable, thereby enabling an offset of a plane of the guide (40) relative to a workpiece plane, and/or wherein the plane of the guide (40) is tiltable about the z-axis relative to the workpiece plane.

16. The rolling mill stand (1) according to claim 1, wherein the working rolls (20) are conical rolls or barrel rolls with crossed roll axles.

17. The rolling mill stand (1) according to claim 1, wherein the guide (40) is adjustable during a rolling process, and wherein a controller is provided, which calculates parameters of the adjustment of the guide (40) during the rolling process.

18. A rolling mill stand (1) for rolling an elongated workpiece, comprising:

two working rolls (20) forming a rolling gap(S), which are configured to roll the workpiece conveyed along a rolling direction (R); and a guide device (30) having a guide (40) configured to laterally support the workpiece in the rolling gap(S) by the guide (40) being in contact with the workpiece and an angle adjuster (33) which is configured to pivot the guide (40) about one or more spatial axes (x, y, z), a guide frame (32), and a pivot bracket (31), by which the guide frame (32) is mounted on a machine base (10) of the rolling mill stand (1) so as to be pivoting about a first spatial axis (y) and/or a second spatial axis (z) and/or a third spatial axis (x), wherein the pivot bracket (31) comprises a bracket mount (31*a*) that is firmly mounted on the machine base (10) and a bracket body (31*b*) that is mounted on the bracket mount (31*a*) by a pivot pin (31*c*) and can be pivoted about the first spatial axis (y) perpendicular to the rolling direction (R), and a rotating joint (31*d*) that connects the bracket body (31*b*) to the guide frame (32) by a rotating pin (31*e*) so that the guide frame (32) can pivot about the second spatial axis (z), which is perpendicular to the first spatial axis (y) and perpendicular to the rolling direction (R).

19. The rolling mill stand (1) according to claim 18, wherein the rotating joint (31*d*) is mounted on the bracket body (31*b*) so as to be rotatable about the third spatial axis (x) parallel to the rolling direction (R).

20. The rolling mill stand (1) according to claim 18, wherein the guide device (30) comprises an eccentric receptacle (32*a*) and an eccentric bushing (32*b*), which is received in the eccentric receptacle (32*a*) so as to be rotatable about a longitudinal axis.

* * * * *